US008151883B2

(12) United States Patent
Simancas et al.

(10) Patent No.: US 8,151,883 B2
(45) Date of Patent: Apr. 10, 2012

(54) STIMULATION TECHNIQUE FOR OPEN HOLE WELL

(75) Inventors: Ricardo Gomez Simancas, Jakarta (ID); Bryan Stamm, Houston, TX (US); Graham R. Watson, Sugar Land, TX (US); Tom Saunders, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/794,748

(22) Filed: Jun. 6, 2010

(65) Prior Publication Data

US 2010/0314125 A1 Dec. 16, 2010

Related U.S. Application Data

(63) Continuation of application No. 12/705,885, filed on Feb. 15, 2010.

(60) Provisional application No. 61/187,439, filed on Jun. 16, 2009.

(51) Int. Cl.
*E21B 43/04* (2006.01)

(52) U.S. Cl. ..... 166/278; 166/51

(58) Field of Classification Search ..... 166/51, 166/278

See application file for complete search history.

(56) References Cited

U.S. PATENT DOCUMENTS

| | | | | |
|---|---|---|---|---|
| 6,298,916 | B1 * | 10/2001 | Tibbles et al. | 166/278 |
| 6,932,157 | B2 * | 8/2005 | McGregor et al. | 166/278 |
| 6,997,263 | B2 * | 2/2006 | Campbell et al. | 166/374 |
| 7,140,437 | B2 * | 11/2006 | McMechan et al. | 166/278 |
| 7,735,559 | B2 | 6/2010 | Malone | |
| 7,934,553 | B2 | 5/2011 | Malone | |
| 2004/0040707 | A1 | 3/2004 | Dusterhoft et al. | |
| 2008/0066900 | A1 | 3/2008 | Saebi et al. | |
| 2008/0164027 | A1 | 7/2008 | Sanchez | |
| 2008/0283252 | A1 | 11/2008 | Guignard et al. | |
| 2009/0025923 | A1 * | 1/2009 | Patel et al. | 166/51 |
| 2009/0260814 | A1 | 10/2009 | Malone | |
| 2010/0012318 | A1 | 1/2010 | Luce et al. | |
| 2010/0294495 | A1 * | 11/2010 | Clarkson et al. | 166/278 |

FOREIGN PATENT DOCUMENTS

WO 2010009282 A2 1/2010

* cited by examiner

*Primary Examiner* — Giovanna Wright
(74) *Attorney, Agent, or Firm* — David G. Matthews; Rodney Warfford; Robert Van Someren

(57) ABSTRACT

A stimulation technique is provided for use in an open hole well. The stimulation technique utilizes a system which comprises one or more isolation devices positioned to isolate desired regions of the open hole well. At least one release mechanism is used to provide controlled release of stimulation material to a desired wellbore region of the open hole well. Additionally, a protection mechanism cooperates with each release mechanism to prevent undesirable contact between stimulation material and the surrounding wellbore wall of the open hole well. In many applications, the entire system is deployed and operated during a single trip downhole into the well.

19 Claims, 5 Drawing Sheets

STIMULATION TECHNIQUE FOR OPEN HOLE WELL

CROSS REFERENCE TO RELATED APPLICATION

The present document is a continuation of patent application Ser. No. 12/705,885, filed on Feb. 15, 2010, and the present document also claims priority under 35 U.S.C. §119 (e) to U.S. Provisional Patent Application Ser. No. 61/187,439, filed on Jun. 16, 2009, the contents and disclosures of which are herein incorporated by reference in their entirety.

FIELD

Embodiments described relate to stimulation tools and applications directed at open-hole wells. In particular, tools and techniques which allow for the positioning of a recovery screen at a production region are disclosed. More specifically, positioning in a manner that allows isolation of the screen from contaminants such as water while allowing communication and circulation for purposes of stimulation is disclosed. Embodiments described herein also protect the open wellbore wall and allow for such stimulation in a multi-zonal fashion.

BACKGROUND

Exploring, drilling and completing hydrocarbon and other wells are generally complicated, time consuming and ultimately very expensive endeavors. In recognition of these expenses, added emphasis has been placed on well logging, profiling and monitoring of well conditions throughout the productive life of the well. With the most accurate and up to date information available, a considerable amount of time and money may be saved in managing production from the well. Similarly, over the years, added emphasis has been placed on other time saving measures such as performing well applications with as few a number of physical interventions as practical. For example, in many situations a series of related applications may be run by way of a single deployment of a toolstring into the well as opposed to several separate deployments of individual application tools into the well.

One such opportunity for reducing the number of well interventions is in the area of well stimulation. As used herein, the term "well stimulation" is meant to refer to fracturing, gravel packing, or any number of well treatment applications directed at stimulating a formation reservoir in order to encourage and maintain hydrocarbon recovery therefrom. For example, in many circumstances a cased well may be present with a perforated production region at the reservoir. That is to say, openings or perforations may traverse the casing and extend into the surrounding formation reservoir. However, in order to optimize hydrocarbon recovery from the reservoir, stimulation applications may be carried out at the region. Indeed, as noted below, multiple stimulation application procedures may be carried out at the region with a single trip in the well of a properly configured toolstring. As such, the time required for multiple deployments of different application tools to the region may be condensed into a single 'stimulation' trip, saving countless hours and capital expenditures.

As indicated, a toolstring may be configured to carry out multiple related stimulation applications near a perforated region of a cased well. For example, the same toolstring may be equipped to carry out a fracturing application, followed by a gravel packing application and hydrocarbon recovery upon a single delivery of the toolstring to the site of the perforated region. More specifically, a fracturing application may be applied where a proppant containing slurry is directed from a release mechanism of the toolstring toward the noted perforations. In this manner, the perforations may be stimulated and propped open.

A subsequent circulation of a gravel packing slurry may be directed from the same release mechanism or elsewhere toward the noted screen mechanism and exposed portions of the formation (i.e. in the area of the perforations). As such, the formation may be supported and the screen mechanism tightly secured in place. In this manner, reliable hydrocarbon recovery may proceed through the porous gravel pack occupying the space between the screen mechanism and the perforated region. Furthermore, fracturing, gravel packing, and production through the screen mechanism may all be achieved through a single deployment of the toolstring. Indeed, in certain situations, the toolstring may even be equipped with a perforating gun so as to allow formation of the perforations in advance of the described stimulating applications. That is to say, even perforating may be achieved as part of the single toolstring deployment.

Unfortunately, while the above described stimulation techniques may be cost effectively employed on a single trip in a cased well, they may be ineffective altogether when such a toolstring is delivered to an open-hole well. Unlike a cased well, an open-hole well may include a variety of exposed formation layers, some of which may hinder effective recovery through a screen mechanism, even where fracturing and/or gravel packing has been employed at the production region. That is, as in the exemplary circumstance below, conditions at formation layers outside of the production region may have an impact on recovery due to the open-hole nature of the well.

Often times, hydrocarbon recovery efforts are directed at oilfield formations that are primarily alternating layers of sand and shale. The thin sand layers in particular, may be good candidates for perforating, fracturing, and hydrocarbon recovery. By the same token, the predominantly shale makeup of the formation layers may allow the well to remain un-cased without undue concern over its structural soundness for follow-on applications. Thus, the cost of casing the well may be saved.

Unfortunately, even a properly positioned screen mechanism at the thin sand layer is subject to water and other contaminants emanating from other surrounding layers such as the shale layers. In the case of water contamination, hydrocarbon production through the screen may be rendered ineffective. Additionally, with no casing, the gravel slurry or other treatment material can have a substantial, negative effect on the surrounding wellbore wall of the open hole well. Thus, as a practical matter, fracturing, gravel packing and follow-on hydrocarbon recovery are not pursued via use of a single toolstring employed on a single trip in an open-hole well.

SUMMARY

A stimulation technique is provided for use in an open hole well. The stimulation technique utilizes a system which comprises one or more isolation devices positioned to isolate desired regions of the open hole well. At least one release mechanism is used to provide controlled release of stimulation material to a desired wellbore region of the open hole well. Additionally, a protection mechanism cooperates with each release mechanism to prevent undesirable contact between stimulation material, e.g. gravel slurry, and the surrounding wellbore wall of the open hole well. The protection mechanism also may be used to protect the open hole well from undesirable screenout pressure. In many applications, the entire system may be deployed and the stimulation technique carried out in a single trip downhole into the open hole well.

DETAILED DESCRIPTION

Embodiments are described with reference to certain stimulation tools and techniques employed in an open-hole well. For example, embodiments herein focus on gravel packing applications. However, a variety of stimulation applications may take advantage of embodiments of open-hole stimulation systems as detailed herein.

For example, the technique may be employed in fracturing applications and in non-gravel packing treatments. Examples of well treatment techniques comprise screenless techniques, e.g. resin consolidation techniques, resin coated gravel techniques, frac techniques with consolidated material, and other stimulation techniques. Individual stimulation/treatment techniques or combinations of different techniques may be employed during the same trip downhole. Regardless, embodiments of stimulation systems detailed herein may be particularly configured for use in open-hole wells and may even be employed in a multi-zonal fashion in many environments.

Figure 1:
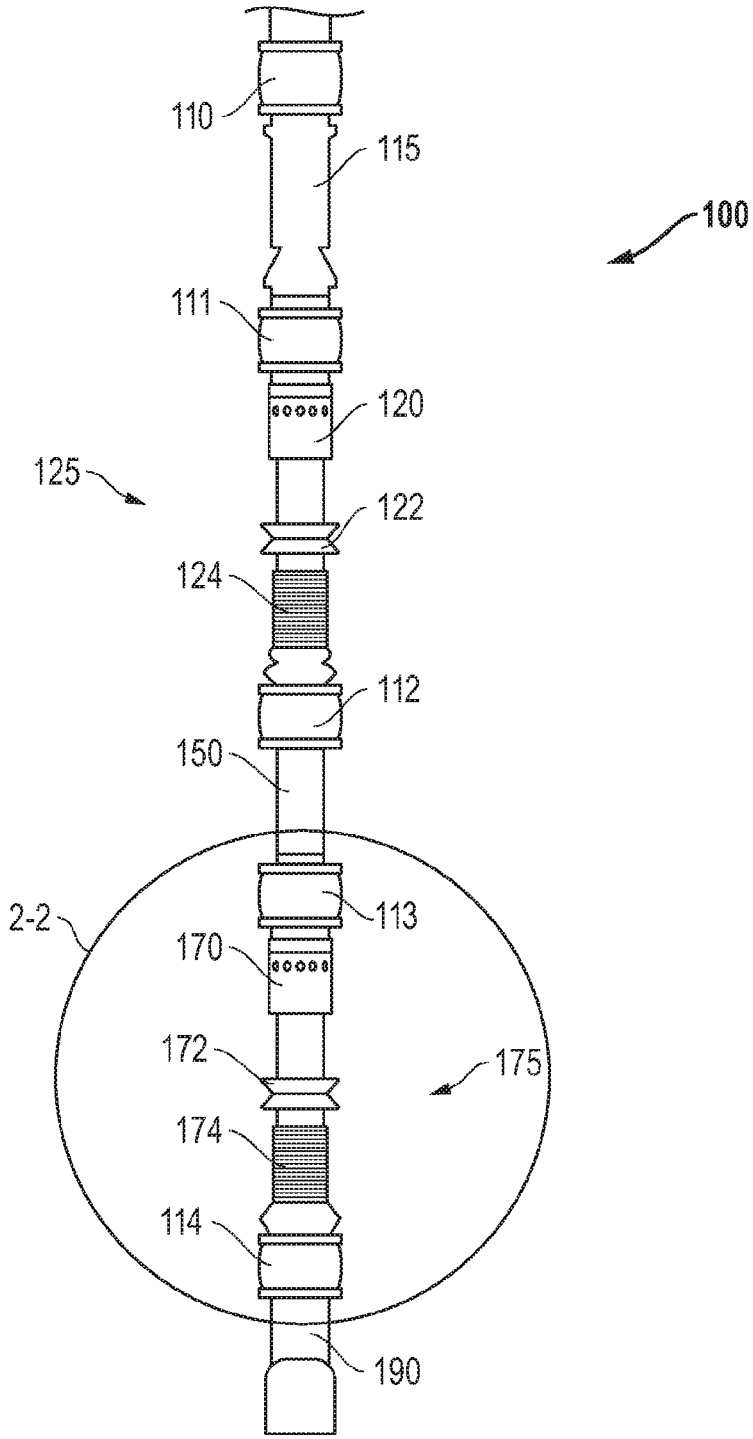
FIG. 1 is a side view of an embodiment of an open-hole stimulation system.

Referring now to FIG. 1, a side view of an embodiment of an open-hole stimulation system 100 is shown. With added reference to FIG. 4, the system 100 is configured with multiple stimulation assemblies 125, 175 for carrying out multiple stimulation applications at different locations within a well 280 as detailed below. While two assemblies 125, 175 are depicted in FIGS. 1 and 4, any practical number of assemblies may be incorporated into the same system 100, depending, for example, on the number of production regions 225, 425 to be traversed by the system 100.

Figure 3:
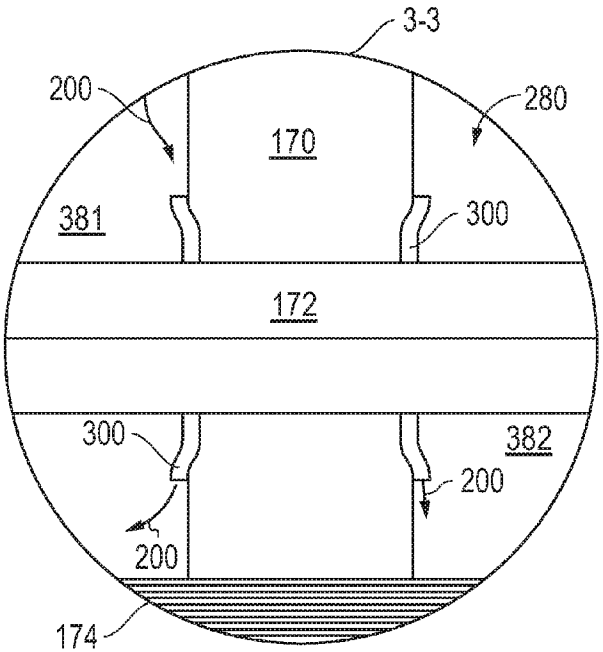
FIG. 3 is an enlarged view of an isolation packer of the downhole assembly taken from 3-3 of FIG. 2 and revealing shunt tubes for circulation during the stimulation.

Each stimulation assembly 125, 175 of the system 100 is outfitted with a slurry release mechanism 120, 170 uphole or above a recovery screen 124, 174. Each screen 124, 174 may range from about 4 inches to about 8 inches in diameter and be up to several feet or more in length depending on the size of the affiliated production region 225, 425 (see FIG. 4). Additionally, due to the open-hole nature of the system, an isolation packer 122, 172 is disposed between the release mechanisms 120, 170 and screens 124, 174. In this manner, a downhole region 382 of the well 280 may be isolated from an uphole region 381 as depicted at FIG. 3. As such, a given screen 174 and production region 225 may be isolated from contaminants such as water which, as detailed further below, may be prone to emanate from an adjacent formation layer 290 of the open-hole well 280 (see FIG. 2).

Unlike a conventional stimulation system, the system 100 of FIG. 1 is configured for positioning in an open-hole well 280 as noted. Thus, the isolation packers 122, 172, as well as a host of setting packers 110, 111, 112, 113, 114 are provided which are of sufficient expansion variability for effective use in open-hole wells. Such packers (122, 172, and 110-114) may be mechanical, hydraulic or of a swellable material, e.g. swellable elastomer, and range in diameter from about 5 inches to about 15 inches depending on well dimensions.

Figure 4:
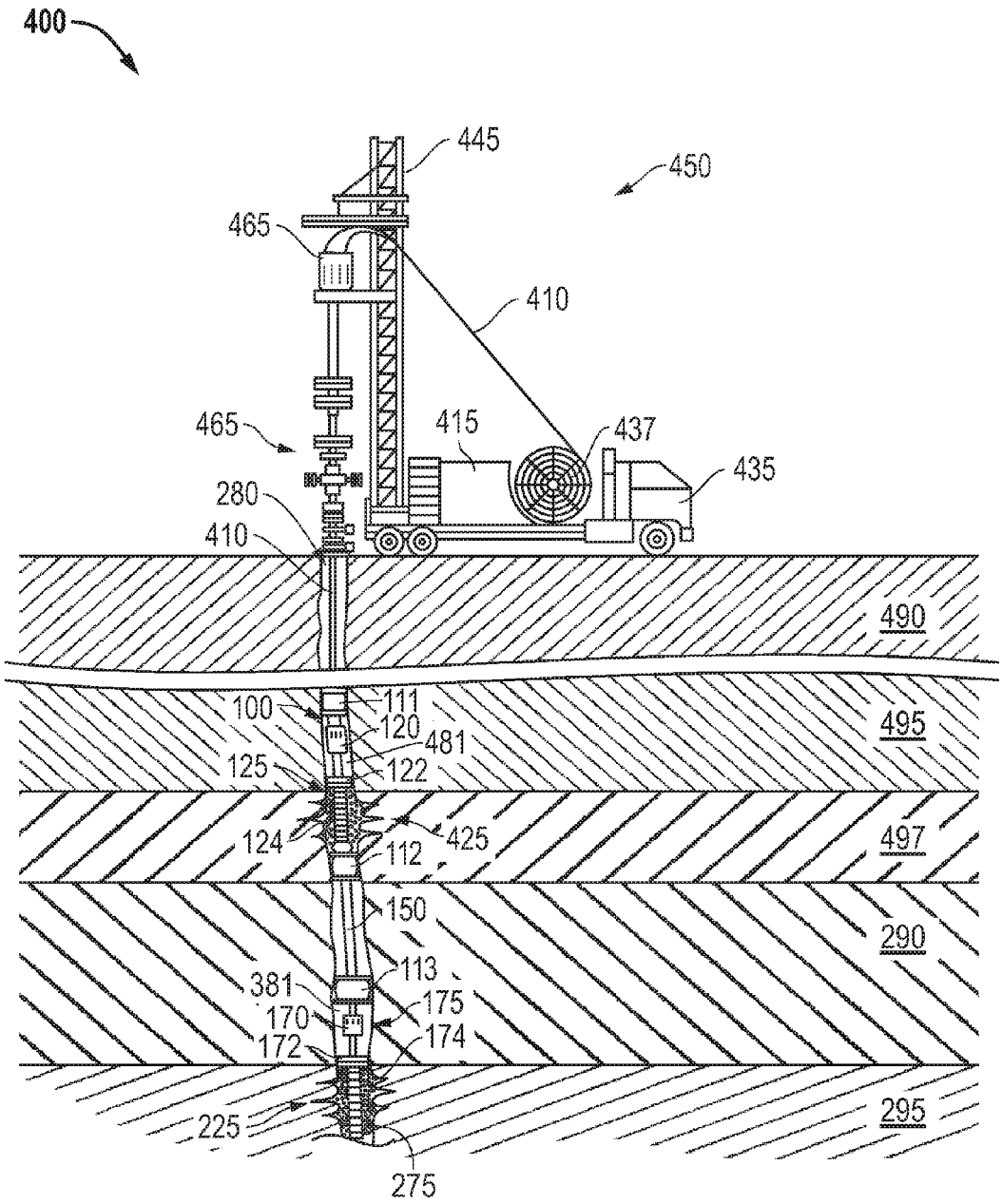
FIG. 4 is an overview of an oilfield with an open-hole well accommodating the stimulation system of FIG. 1.

Continuing with reference to FIG. 1 and added reference to FIG. 4, each assembly 125, 175 may be separated by a space out pipe 150. The pipe 150 may be standard 2 to 5 inch diameter production tubing of a tailored length based on the distance between adjacent production regions 225, 425 as noted above. For example, depending on the architecture of the well 280, the pipe 150 may range anywhere from 10 feet to several hundred feet in length.

The system 100 also may be equipped with additional tools such as a consolidation tool 115, washdown shoe 190 and others. In the embodiment shown, a pressure testing implement such as a ball drop sub may be incorporated above the washdown shoe 190. Additionally, the shoe 190 itself may be provided to advance downhole installation of the system 100 such as depicted in FIG. 4. For example, the shoe 190 may be employed to circulate fluids below the system 100 such as swelling or filtercake breaking fluids as an aid in positioning the system 100 downhole.

The above described tools may each be selectively and individually actuated. For example, a sliding sleeve may be built into the consolidation tool 115 as well as each recovery screen 124, 174. Similarly, internal shifting devices may be employed to separately direct each of the slurry release mechanisms 120, 170. Thus, in an application sense, the system 100 is controllable for each individual well zone of a plurality of well zones. That is, whether performing a stimulation technique, e.g. packing or resin consolidating, or recovering from a particular production region 225, 425 (see FIG. 4), each such location may be individually controlled, for example, leaving other locations isolated and/or closed off as necessary. Consequently, different stimulation techniques may be employed in different well zones during a single deployment downhole into the well 280. For example, one well zone may be gravel packed while another well zone is treated via a resin consolidation injection technique.

Figure 2:
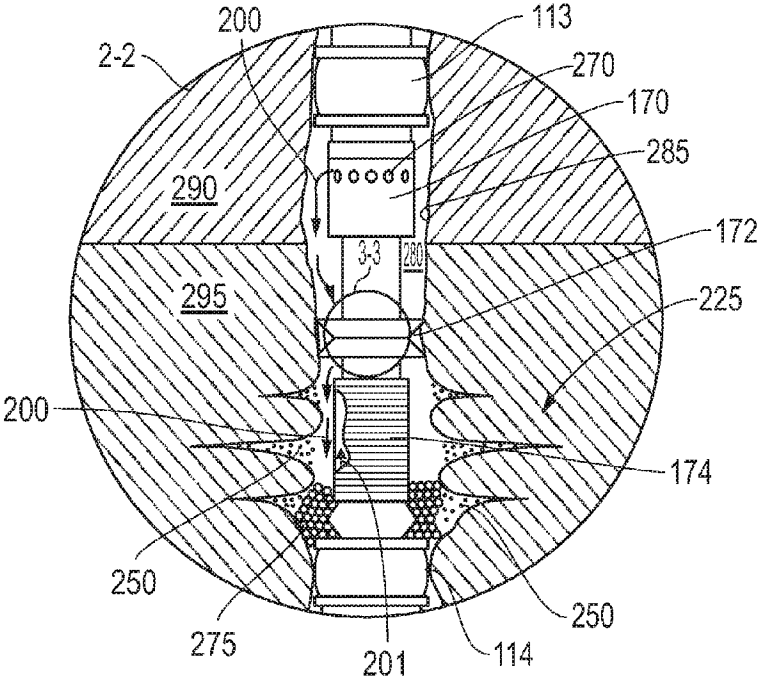
FIG. 2 is an enlarged view of a downhole assembly of the system taken from 2-2 of FIG. 1 and positioned at a production region during a stimulation application.

Referring now to FIG. 2, an enlarged view of the downhole assembly 175 of the system 100 is shown taken from 2-2 of FIG. 1. In this view, the assembly 175 is located within an open-hole well 280 at a production region 225 during a stimulation application. More specifically, the assembly 175 is depicted with a gravel packing application directed at the recovery screen 174 and region 225.

The assembly 175 is secured at a wall 285 of the well 280 by setting packers 113, 114 as described above. Additionally, an isolation packer 172 is provided which isolates the recovery screen 174 at the region 225. For example, in the embodiment shown, the production region 225 may be located at a particular sand-based formation layer 295 adjacent another formation layer 290 of shale. Due to the presence of the packers 114, 172 adjacent the region 225, the screen 174 may be substantially isolated at the sand-based formation layer 295. That is to say, the screen 174 may be substantially cut off from communication with the shale layer 290. Such isolation may be employed to reduce the likelihood of the screen 174 coming into contact with contaminants such as water from outside of the production region 225. For example, water may often be found at a neighboring shale layer 290. Nevertheless, as indicated, the lack of a protective casing at the well wall 285 outside of the production region 225 may be substantially overcome due to the manner of isolation employed at the region 225.

Continuing with reference to FIG. 2 with added reference to FIG. 3 (an enlarged view of the noted isolation packer 172), the recovery screen 174 is substantially isolated at a downhole region 382 between setting 114 and isolating 172 packers. However, the slurry release mechanism 170 is located at an uphole region 381 above the isolating packer 172. A protection mechanism 300, such as the shunt tubes illustrated in FIG. 3, may be selectively actuated with an internal shifting tool to allow temporary communication between the uphole 381 and downhole 382 regions. Isolation packer 172 extends outwardly around the shunt tubes. As such, a gravel packing application (or other stimulation application) may effectively proceed whereby a gravel slurry 200 is driven from ports 270 of the slurry release mechanism 170 toward the screen 174. The shunt tubes 300 accommodate a flow of the slurry 200 allowing it to reach the location of the screen 174. Following completion of the packing application as depicted in FIG. 4, the valving of the shunt tubes 300 may be closed off with the noted internal shifting tool. Indeed, such opening and closing as directed by the shifting tool may be actuated from the surface of the oilfield 400 as described further below. The protection mechanism 300, e.g. shunt tubes, also helps restrict stimulation materials, e.g. fluids which are exiting crossover ports 270, from undue contact with the open wellbore wall prior to reaching the region surrounding screen 174. Protection mechanism 300 also limits the effects of screenout pressure acting on the open hole section of the well. Examples of protection mechanisms 300 include shunt tubes routed through a shunt tube packer, shunt tubes in a swellable packer, or a shroud as discussed in greater detail below with reference to FIG. 5.

As shown in FIG. 2, a proppant 250 from a prior fracturing application may be present at perforations of the production region 225. Thus, structural support may be provided to the perforations. However, as shown, further stimulation in the form of gravel packing may be employed to help vertically and radially reinforce the region 225. So, for example, the above noted gravel slurry 200 may be directed to a location between the screen 174 and sand formation 295. The slurry 200 may include a combination of gravel 275 and inert fluid 201. As shown, the gravel packing application may be employed to deliver gravel 275 from the slurry 200 to the area between the screen 174 and formation. At the same time, the screen 174 may be mechanically configured to allow the inert fluid 201 a return path there-across. Thus, the gravel 275 may be effectively filtered out of the slurry 200 and packed in the area shown, thereby helping to reinforce the formation 295 and set the screen 174 in place.

In the embodiment shown in FIG. 2, the setting packers 113, 114 are employed at the interface of a shale layer 113 and at the lower portion of a sand layer 295. However, locating these packers 113, 114, which define the overall boundaries of the assembly 175, may be a matter of individual design choice. For example, such locating may depend on the structural makeup, permeability and other characteristics of layers adjacent a production region. In this regard, the setting packers 113, 114 may both be located in adjacent layers in an embodiment where both such layers are substantially non-permeable, thereby ensuring isolation of the entire assembly 175.

Referring now to FIG. 4, an overview of an oilfield 400 is depicted whereat the above described open-hole well 280 is located. Indeed, the well 280 is depicted accommodating the stimulation system 100 of FIG. 1. The system 100 includes multiple stimulation assemblies 125, 175 for carrying out multiple stimulation applications at multiple production regions 225, 425. As shown, the applications are gravel packing. However, other types of stimulation applications may be employed at the regions 225, 425 via the system 100. Some of the other types of stimulations include screenless stimulation techniques, e.g. resin consolidation stimulation techniques, resin coated gravel stimulation techniques, frac techniques with consolidated material, and combinations of techniques. Individual stimulation/treatment techniques or combinations of different techniques may be employed during the same trip downhole. Additionally, the stimulation applications may be carried out simultaneously or in series depending upon overall application parameters as well as those for the individual regions 225, 425. Further, note that each isolated assembly 125, 175 is provided with its own release mechanism 120, 170, for example, to allow for individual tailoring of each stimulation application at each individual location. For example, a gravel packing stimulation application may be performed at one location and a non-gravel packing stimulation application may be performed at another location during the single trip downhole.

Continuing with reference to FIG. 4, the system 100 is shown deployed into the well 280 via a conveyance 410, such as coiled tubing. The coiled tubing 410 is positioned at the well site by way of a conventional coiled tubing truck 435 and reel 437. In the embodiment shown, the coiled tubing 410 is run from the reel 437 to a standard gooseneck injector 465 supported by a mobile rig 445. As such, the coiled tubing may be forcibly advanced through pressure control equipment 465, often referred to as a "Christmas Tree". This deployment may be directed through a control unit 415 at the truck 435 which may be coupled to the coiled tubing 410 through a hub at the reel 437. Use of coiled tubing makes the stimulation technique more efficient because the coiled tubing facilitates a single trip stimulation application after the original rig is moved off the wellbore. This approach decreases the otherwise required rig time and simplifies the overall simulation procedure.

The above-noted control unit 415 also may be employed to direct positioning of the downhole system 100 past certain formation layers (i.e. 490) and appropriately across other downhole formation layers 495, 497, 290, 295 depending on the particular recovery strategy. Accordingly, in the embodiment shown, stimulation assemblies 125, 175 are positioned with recovery screens 124, 174 adjacent production regions 425, 225 of certain formation layers 497, 295. Thus, open-hole packers 111-113 may be set, for example, as directed by the surface control unit 415. Indeed, in spite of the inherent variability in the diameter of the open-hole well 280, once set, the open-hole packers 111-113 allow for sufficient retention and stability of the system 100 at the depicted location.

Isolating packers 122, 172 may also be set so as to substantially isolate the screens 124, 174 as detailed hereinabove. Therefore, even in circumstances where the producing formation layer 497, 295 is a relatively thin sand layer surrounded by adjacent contaminant prone layers 495, 290, the screens 124, 174 remain protected. For example, the screens 124, 174 would remain isolated from exposure to water from adjacent shale layers 495, 290. Again setting of the isolating packers 122, 172 may be directed from the control unit 415 at surface.

Once positioned, and properly isolated as described above, a stimulation application may be run. For example, in the embodiment shown, a gravel packing application has been completed as detailed above. As depicted in FIG. 4, gravel 275 provides a supportive interface between the screens 124, 174 and noted production regions 425, 225. Internal sliding sleeves may be directed by the surface control unit 415 to allow a slurry, including the gravel 275, to be deposited as shown from gravel release mechanisms 120, 170.

With the completion of gravel packing, the system 100 may be ready for hydrocarbon recovery. Thus, while the space out pipe 150 of the system 100 may be conventional production tubing, it may be desirable to replace coiled tubing 410 by advancing jointed pipe or additional production tubing to interface the system 100 in the well 280. In some embodiments, the system 100 may be advanced into position as shown by way of jointed pipe from the outset. In yet another embodiment, the architecture of the well 280 may be cased to a certain depth with the open-hole stimulation system 100 suspended therefrom. That is, the system 100 may be particularly configured to address the narrow set of recovery issues present beyond the limits of an otherwise cased well.

Figure 5:
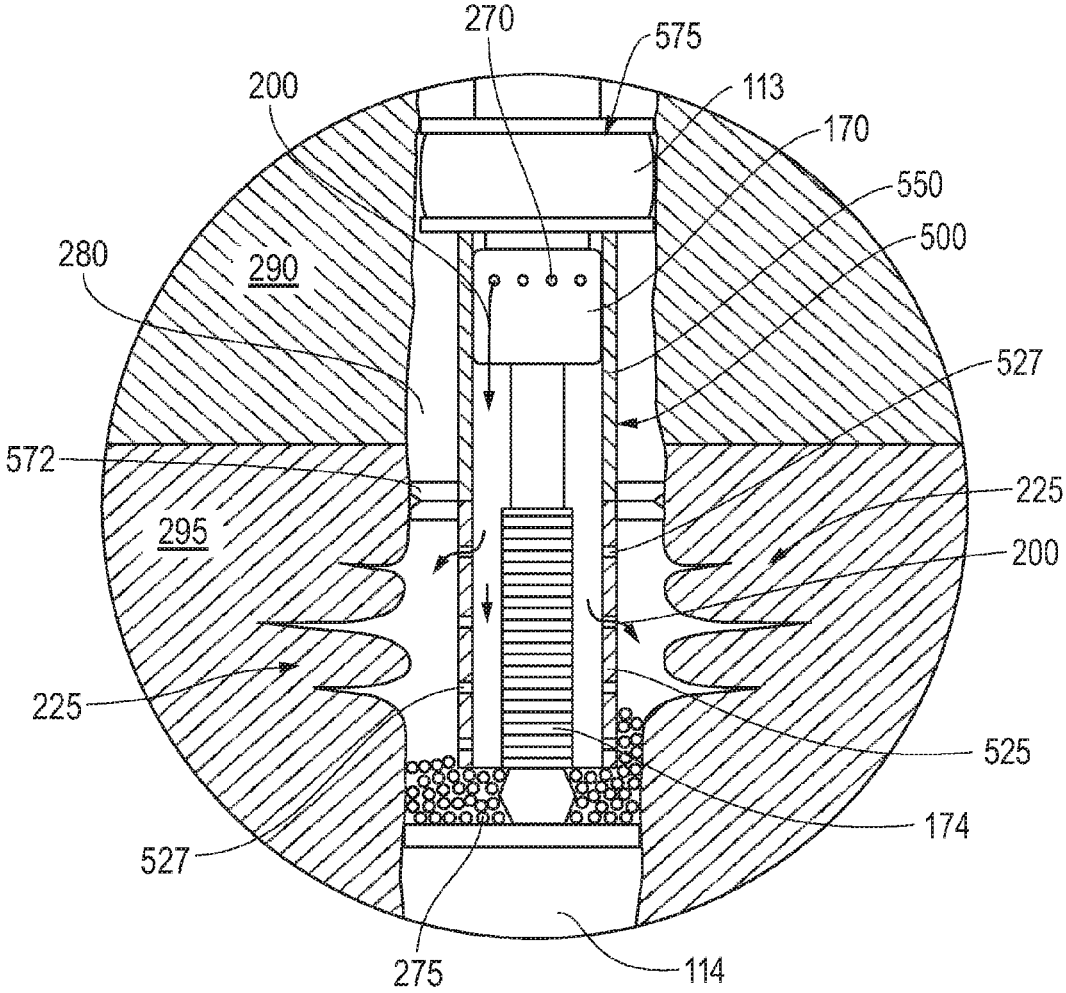
FIG. 5 is a depiction of an alternate embodiment of an assembly of the system as compared to that of FIG. 2.

Referring now to FIG. 5, an alternate embodiment of a stimulation assembly 500 is depicted, particularly as compared to that of FIGS. 2 and 3. In this embodiment, communication between the slurry release mechanism 170 and the location of the recovery screen 174 takes place through protection mechanism 300 in the form of a shroud 500 as opposed to the shunt tubes illustrated in FIG. 3. As shown in FIG. 5, the shroud 500 is disposed between adjacent setting packers 113, 114 with an isolation packer 572 positioned around the shroud 500 and extending outwardly from the shroud 500 to enable engagement with the surrounding wellbore wall of the open hole wellbore. Thus, in lieu of shunt tubes 300, the noted communication between the release mechanism 170 and screen 174 may take place through an anterior of the shroud 500. The shroud 500 also protects the surrounding open wellbore wall from stimulation materials, such as gravel packing slurry and other fluids. For example, shroud 500 helps restrict stimulation materials, e.g. fluids which are exiting crossover ports 270, from undue contact with the open wellbore wall prior to reaching the region surrounding screen 174. The shroud 500 also limits the effects of screenout pressure acting on the open hole section of the well.

In the embodiment of FIG. 5, a solid portion 550 of the shroud 500 is present above the isolation packer 572. This solid portion 550 is of a solid cylindrical configuration and is sealed at a location above ports 270 of the slurry release mechanism 170. In the embodiment illustrated, the solid portion 550 extends down past the upper end of screen 174. Thus, communication between the screen 174 and portions of the open-hole well 280 above this packer 572 is prevented. As with prior embodiments, such communication may be prevented as a manner of avoiding exposure of the screen 174 to contaminants such as water from outside of the production region 225. In some embodiments, a perforated portion 525 of the shroud 500 may be present below the isolation packer 572. Thus, as described below, flow may be allowed out of the bottom of the shroud 500 or through perforations 527.

As with prior embodiments, a stimulation application such as gravel packing may proceed with a gravel slurry 200 directed from the slurry release mechanism toward the recovery screen 174. As depicted, the slurry 200 may deposit gravel 275 below the shroud 500 and through perforations 527 thereof. As indicated above, the application may proceed until the screen 174 and shroud 500 are adequately stabilized along with the formation 295 itself. Furthermore, the structural support of the shroud 500 may provide substantial radial reinforcement to the production region 225. Thus, in circumstances where the formation 295 is prone to break down and/or the gravel pack becoming dehydrated or otherwise deficient, the shroud 500 may prevent formation collapse upon the screen 174. As such, recovery through the screen 174 may remain possible once initiated by a shifting tool as described above. It should be noted that non-gravel pack stimulation applications and other types of stimulation applications may be performed at select regions of the well with an assembly employing shroud 500 or employing another suitable protection mechanism 300.

Figure 6:
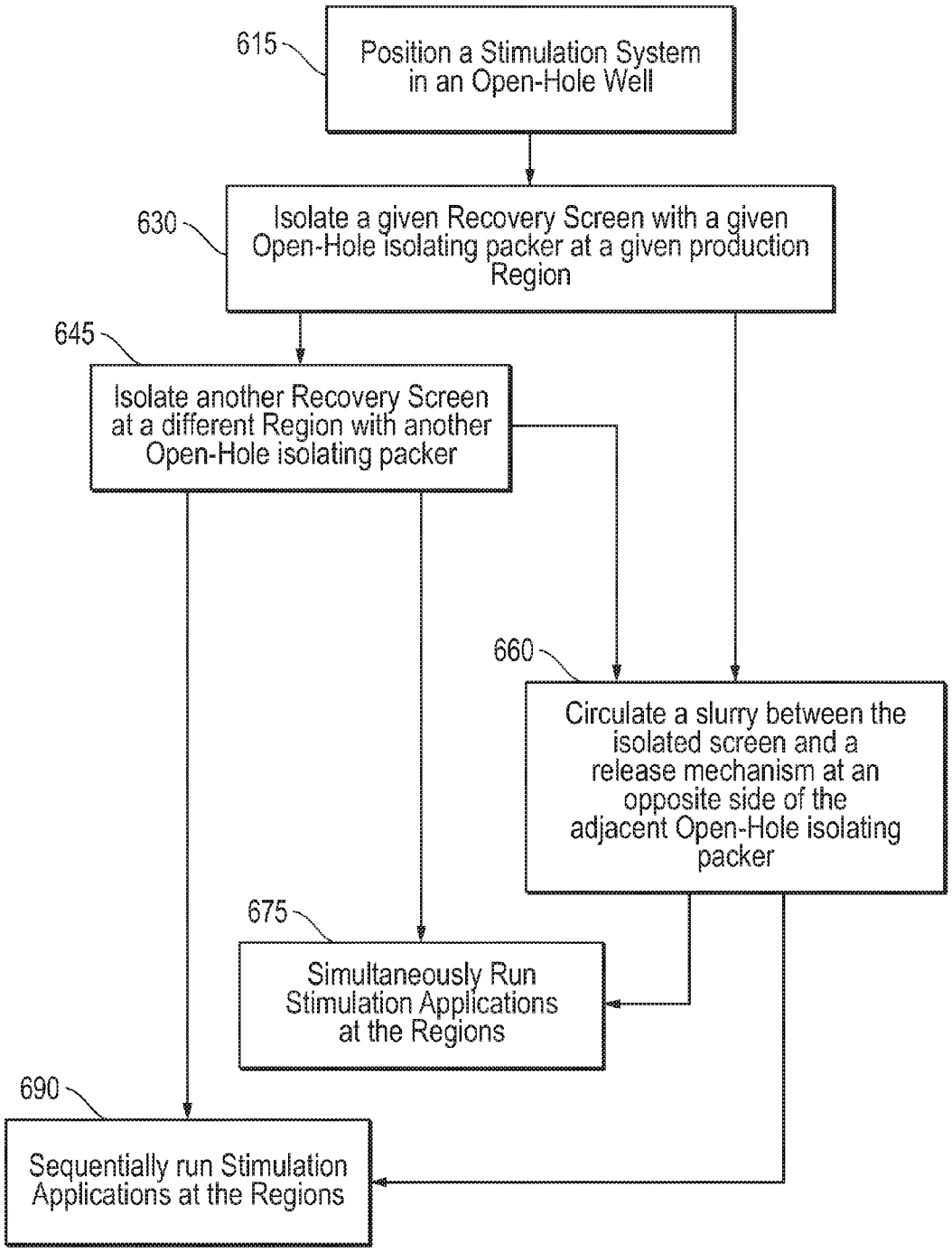
FIG. 6 is a flow-chart summarizing an embodiment of employing an open-hole stimulation system in a well.

FIG. 6 is a flow-chart summarizing an embodiment of employing an open-hole stimulation system in a well. As indicated at 615, the system may be initially positioned downhole. This may be achieved via coiled tubing, although jointed pipe or other appropriate devices may be used in some applications. Once properly positioned, a screen may be isolated at a given production region as indicated at 630. Further, as noted at 645, this may include the isolation of multiple screens at multiple regions.

Once properly isolated, a stimulating slurry may be circulated across an isolating packer as indicated at 660. As detailed herein, this may be achieved via flow through a protection mechanism, e.g. flow through shunt tubes or through the confines of a shroud. In the case of a shroud, the added advantage of formation support may also be achieved. Furthermore, as indicated at 675 and 690, where multiple stimulating isolations are to be run with the system, they may be run simultaneously or sequentially, depending on the parameters of the operation.

Embodiments described hereinabove provide stimulation systems and techniques directed at open-hole hydrocarbon wells. These embodiments may be particularly well suited for use at oilfield formations with intervening layers of sand and shale. The embodiments allow for bypassing of complete well casing throughout the well which may translate into substantial cost savings in terms of completions operations. Furthermore, in spite of the open-hole nature of the systems, such cost savings may be achieved without undue risk of exposure of recovery screens to water or other contaminants Additionally, the systems may be constructed for multi-zone placement of multiple screens, each with their own dedicated slurry delivery mechanism. Thus, multiple stimulations may take place simultaneously or sequentially at a variety of downhole production regions.

Persons skilled in the art and technology to which the embodiments described herein pertain will appreciate that alterations and changes in the described structures and methods of operation may be practiced without meaningfully departing from the principle, and scope of these embodiments. For example, embodiments herein detail stimulation in the form of gravel packing. However, other stimulation applications may be performed with embodiments of an open-hole stimulation system as detailed herein. Indeed, fracturing, consolidation applications may utilize embodiments as disclosed herein. Furthermore, the foregoing description should not be read as pertaining only to the precise structures described and shown in the accompanying drawings, but rather should be read as consistent with and as support for the following claims, which are to have their fullest and fairest scope.

We claim:

1. A system for stimulating a well, comprising:

a release mechanism comprising at least one port through which a well stimulation material is directed in an open hole wellbore;

a screen positioned to facilitate recovery of a hydrocarbon fluid; and a protection mechanism extending through at least a portion of the distance between the at least one port and the screen, the protection mechanism directing the well stimulation material to a region around the screen, the protection mechanism also containing the well stimulation material to prevent contact between the well stimulation material and a surrounding open hole wellbore wall as the well stimulation material travels from the at least one port to the region around the screen.

2. The system as recited in claim 1, wherein the protection mechanism limits the screenout pressure that would otherwise act on the open hole wellbore wall.

3. The system as recited in claim 1, wherein the protection mechanism comprises a shroud having a solid portion enclosing the at least one port and extending to a position overlapping a first end of the screen.

4. The system as recited in claim 3, wherein the shroud further comprises a perforated portion extending from the solid portion and along an exterior of the screen.

5. The system as recited in claim 3, further comprising a packer positioned around the shroud for engagement with the surrounding open hole wellbore wall to isolate two regions of the open hole wellbore.

6. The system as recited in claim 1, wherein the protection mechanism comprises a shunt tube extending through a packer.

7. The system as recited in claim 1, further comprising a second release mechanism, a second screen, and a second protection mechanism positioned in another region of the open hole wellbore to enable stimulation of another well region.

8. The system as recited in claim 7, wherein the release mechanism and the second release mechanism are employed to apply different types of well stimulation in different well regions during a single trip downhole into the open hole wellbore.

9. The system as recited in claim 1, wherein the release mechanism is a slurry release mechanism to enable gravel packing of the region around the screen.

10. A method for stimulating a well, comprising:

delivering a plurality of stimulation assemblies downhole into an open hole section of a wellbore;

treating different regions of the well by performing different types of well stimulation applications in the open hole section via the plurality of stimulation assemblies; and using a protection mechanism in each stimulation assembly of the plurality of stimulation assemblies to protect the surrounding wellbore wall of the open hole section from undesirable contact with well stimulation material during a well stimulation application, wherein using comprises using a shroud positioned to extend from a well stimulation material release mechanism to a production fluid recovery screen, and wherein using also comprises positioning a packer around the shroud to separate regions of the open hole section.

11. The method as recited in claim 10, wherein treating comprises performing a gravel pack treatment in one region of the well and a non-gravel pack treatment in another region of the well.

12. The method as recited in claim 10, wherein treating comprises performing a resin consolidation treatment in one region of the well and a non-resin consolidation treatment in another region of the well.

13. The method as recited in claim 10, wherein delivering comprises delivering the plurality of stimulation assemblies to treat the different regions of the well in a single trip downhole.

14. The method as recited in claim 10, wherein using comprises using the shroud having a solid portion, extending from the stimulation material release mechanism down to the production fluid recovery screen, and a perforated portion positioned around the production fluid recovery screen.

15. A system for stimulating a well, comprising:

a well stimulation assembly deployed downhole into an open hole wellbore via a conveyance, the well stimulation assembly comprising a stimulation material release mechanism, a screen, and a shroud extending from the stimulation material release mechanism to the screen, the shroud being positioned to limit contact between stimulation material and the wellbore wall of the open hole wellbore as the stimulation material travels from the stimulation material release mechanism to a region surrounding the screen, wherein the well stimulation assembly further comprises a packer positioned between an exterior of the shroud and the surrounding wellbore wall of the open hole wellbore.

16. The system as recited in claim 15, wherein the shroud is positioned to protect the surrounding wellbore wall of the open hole wellbore wall from screenout pressure.

17. The system as recited in claim 15, wherein the shroud comprises a solid portion extending from an exit port of the stimulation material release mechanism to at least an end of the screen closest to the stimulation material release mechanism.

18. The system as recited in claim 17, wherein the shroud also comprises a perforated portion disposed around the screen.

19. The system as recited in claim 15, wherein the conveyance is coiled tubing.

* * * * *